US006976902B2

(12) United States Patent
Koo et al.

(10) Patent No.: US 6,976,902 B2
(45) Date of Patent: Dec. 20, 2005

(54) CHEMICAL MECHANICAL POLISHING APPARATUS

(75) Inventors: Ja-Eung Koo, Gyeonggi-do (KR); Jong-Won Lee, Gyeonggi-do (KR); Sung-Bae Lee, Gyeonggi-do (KR); Duk-Ho Hong, Gyeonggi-do (KR); Sang-Rok Hah, Seoul (KR); Hong-Seong Son, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/850,688

(22) Filed: May 21, 2004

(65) Prior Publication Data

US 2005/0048875 A1 Mar. 3, 2005

(30) Foreign Application Priority Data

Sep. 3, 2003 (KR) ..... 10-2003-0061582

(51) Int. Cl.[7] ..... B24B 1/00

(52) U.S. Cl. ..... 451/7; 451/6; 451/10; 451/11; 451/41; 451/53; 451/288; 156/345.16; 156/345.25

(58) Field of Search ..... 451/7, 6, 9, 10, 451/11, 41, 53, 63, 285, 287, 288; 438/692, 438/693; 156/345.16, 345.25

(56) References Cited

U.S. PATENT DOCUMENTS 5,337,015 A * 8/1994 Lustig et al. ..... 324/671
5,643,050 A * 7/1997 Chen ..... 451/10
6,007,408 A * 12/1999 Sandhu ..... 451/41
6,077,783 A * 6/2000 Allman et al. ..... 438/691
6,190,234 B1 2/2001 Swedek et al.
6,261,155 B1 * 7/2001 Jairath et al. ..... 451/41
6,413,147 B1 * 7/2002 Litvak ..... 451/7
6,664,557 B1 * 12/2003 Amartur ..... 250/559.27
6,726,530 B2 * 4/2004 Mikhaylich et al. ..... 451/8
6,827,629 B2 * 12/2004 Kim et al. ..... 451/5

* cited by examiner

*Primary Examiner*—Eileen P. Morgan
(74) *Attorney, Agent, or Firm*—Marger Johnson & McCollom, P.C.

(57) ABSTRACT

There is provided a chemical mechanical polishing apparatus, which may include a polishing table rotated by a polishing table motor and having a pad thereon, a carrier head located above the polishing table to be rotatable by the driving of a carrier head motor and having a wafer located under the bottom thereof, a slurry supplier for supplying a slurry to the upper portion of the polishing table, a first polishing end point detector for detecting a polishing end point through the temperature change of the temperature sensor, at least one temperature sensor for detecting the temperature of a polishing region (the wafer, the pad, and the slurry), and a second polishing end point detector for detecting a polishing end point from the changes of load current, voltage, and resistance of the carrier head motor. Further, instead of the second polishing end point detector, an optical signal polishing end point detector may be employed, for detecting the polishing end point by the light illuminated on the wafer and reflected from the wafer.

20 Claims, 10 Drawing Sheets

CHEMICAL MECHANICAL POLISHING APPARATUS

CROSS-REFERENCE TO RELATED APPLICATION

This application claims the benefit of Korean Patent Application No. 2003-61582, filed Sep. 3, 2003, the disclosure of which is hereby incorporated herein by reference in its entirety.

BACKGROUND OF THE INVENTION

1. Field of the Invention

The present invention relates to a chemical mechanical polishing (CMP) apparatus and more particularly, to a CMP apparatus including an apparatus for detecting a polishing end point.

2. Description of the Related Art

With multiple-layered lines employed in highly-integrated semiconductor fabrication, the fabrication operation involves processes of forming thin films having desired patterns on a wafer, and planarizing the wafer using a CMP apparatus before repeatedly subsequently forming additional thin films on the wafer.

A CMP process is performed by contacting the surface of a wafer with a polishing pad including a polishing slurry, applying a predetermined pressure onto the wafer, and rotating the polishing pad and the wafer at a predetermined speed so as to simultaneously perform the chemical and mechanical polishing. Certain problems which need to be addressed in the CMP process are detecting the removal rate of the wafer and determining the polishing end point. In the conventional case, the polishing process is performed within a predetermined process time. The polished state of the wafer is determined by visual inspection of the polished surface of the wafer. Therefore, the polished surface may be often overpolished or it may require a further polishing. Currently, the thickness of the layer on the wafer is directly detected during the polishing process by means which are additionally installed in the CMP apparatus. Appropriate polishing end points are detected on the plural portions of the wafer, so as to improve the thickness uniformity of the wafer, and to improve the stability and efficiency of the apparatus. A method of determining the polishing end point can be obtained from (a) the thickness of the wafer measured by a thickness measurement device during the polishing process, (b) a platen and the changes of load current, voltage, and resistance of a wafer carrier motor during the polishing process, and (c) the irradiation of a laser on the wafer and the reflection from the wafer during the polishing process.

The detection of a polishing end point using an optical sensor is disclosed in the U.S. Pat. No. 6,190,234. The sensor uses a plurality of optical end point detect (EPD) systems including a first optical system and a second optical system having different wavelengths. The plurality of EPD systems are said to precisely and quickly detect the polishing end point through one or more windows located under a polishing table.

As described above, the optical systems are installed in a plurality of locations of polishing regions (for example, center, middle, edge). Then, if polishing end points are detected in every location, the polishing process is complete. Since the time of completion of the polishing process is when the polishing end points are detected in every location, in the case where the polishing end points between the locations of the polishing regions are large, a problem may be caused. In this instance, the polishing end point may be detected late, and the wafer may become overpolished. The portion being overpolished may in turn form a recess, due to the accumulation of a slurry, or may produce defects such as dishing and corrosion, etc. Further, in the case of installing the plurality of EPD systems using the optical system at a plurality of locations, the exact polishing end point is difficult to achieve even when one error occurs on any one location. Thus, this causes the resultant problems described above. Additionally, in the case of detecting a polishing end point from the measurement through the change of load current of a motor, the exact polishing end point remains difficult to determine when a current signal exhibits any significant amount of noise.

SUMMARY OF THE INVENTION

Exemplary embodiments of the present invention provide a CMP apparatus for detecting a polishing end point more exactly by detecting a polishing end point through the change of the process temperature while a polishing process goes on, along with the detecting method of a polishing end point through the change of a motor current or through the change of optical waves using an optical system.

In accordance with an exemplary embodiment, the present invention provides the CMP apparatus, which may include a polishing table rotated by a polishing table motor and having a pad thereon, a carrier head located above the polishing table to be rotatable by the driving of a carrier head motor and having a wafer located under the bottom thereof, a slurry supplier for supplying a slurry to the upper portion of the polishing table, at least one temperature sensor for detecting the polishing process temperature of at least one among the wafer, the pad, and the slurry, a first polishing end point detector for detecting a polishing end point through the temperature change of the temperature sensor, and a second polishing end point detector for detecting a polishing end point from the changes of load current, voltage, and resistance of the carrier head motor.

For the detection of the temperature of the wafer, the temperature sensor may be preferably located on the passage in which the wafer is located, and detects the temperature of the wafer through at least one through hole penetrating the polishing pad and the polishing table. Further, a first cover member is preferably provided above the through hole.

For the detection of the temperature of the pad, the temperature sensor may be preferably located on the passage in which the wafer contacts, and detects the temperature of the pad through at least one polishing table through hole penetrating the polishing table.

For the detection of the temperature of the slurry, the temperature sensor may be preferably installed on the bottom edge of the carrier head.

The temperature sensor may preferably use an infrared rays detector.

Further, it is preferable to employ a monitoring unit for displaying the results of the change of the polishing process temperature detected through the first polishing end point detector.

In another aspect of the present invention, the CMP apparatus may be structured to include a polishing table rotated by a polishing table motor and having a pad thereon, a carrier head located above the polishing table to be rotatable by the driving of a carrier head motor and having a wafer located under the bottom thereof, a slurry supplier for supplying a slurry to the upper portion of the polishing table, at least one temperature sensor for detecting the polishing process temperature of at least one among the wafer, the pad, and the slurry, a first polishing end point detector for detecting a polishing end point through the temperature change of the temperature sensor, and an optical signal polishing end point detector installed inside the polishing table and located on the passage in which the wafer contacts, for detecting an optical signal of the light illuminated on the wafer and reflected from the wafer so as to detect the polishing end point.

The above and other features and advantages of the present invention will become more apparent from the preferred embodiments thereof, with reference to the attached drawings, which is hereinafter set forth.

DETAILED DESCRIPTION OF THE INVENTION

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. Like numbers refer to like elements throughout the specification.

Figure 1:
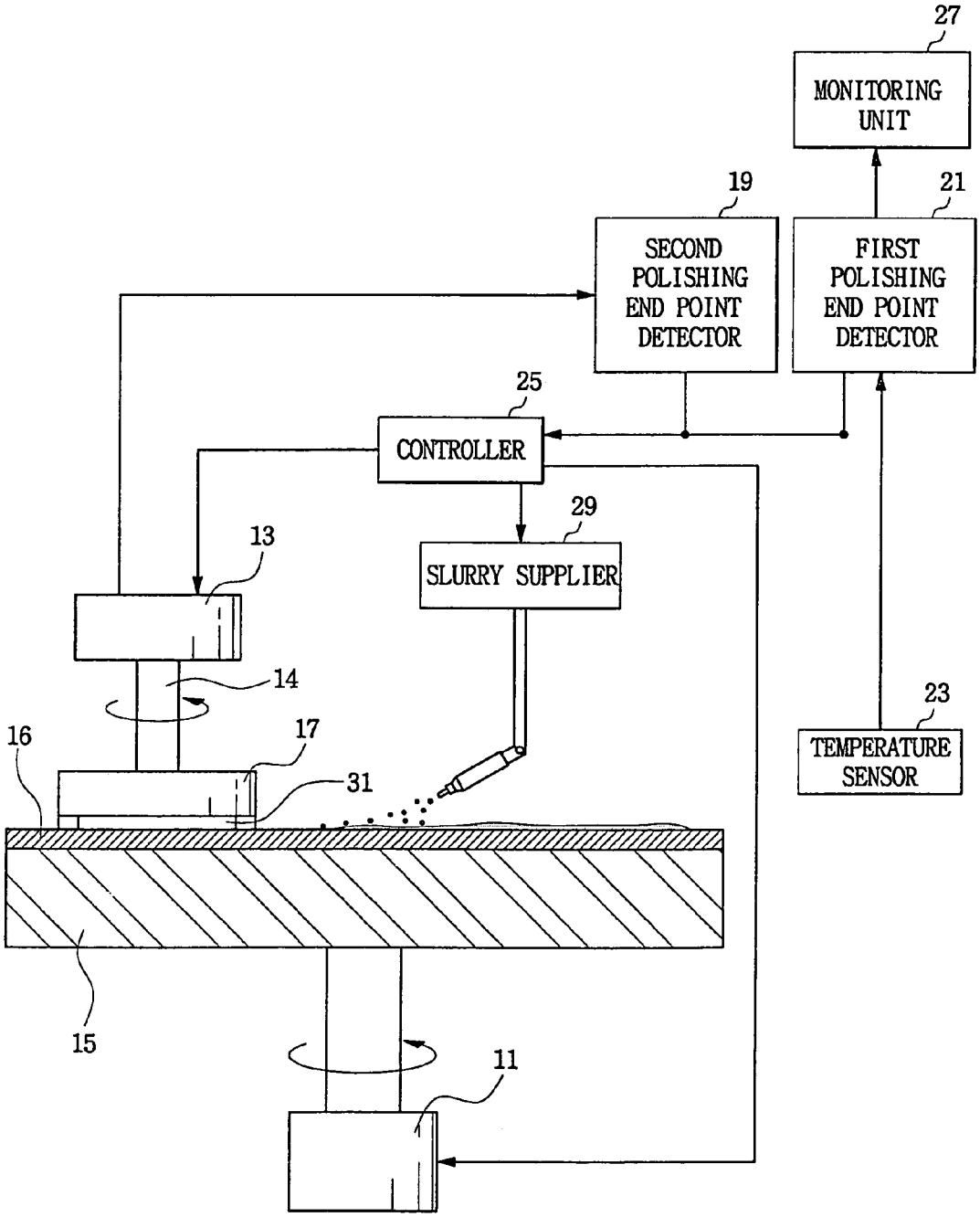
FIG. 1 illustrates the construction of a CMP apparatus according to one embodiment of the present invention.

As shown in FIG. 1, the CMP apparatus according to one embodiment of the present invention is configured to include the following components: a polishing table motor 11, a carrier head motor 13, a polishing table 15, a carrier head 17, a first polishing end point detector 21, a second polishing end point detector 19, a temperature sensor 23, a controller 25, a monitoring unit 27, and a slurry supplier 29.

The polishing table motor 11 is structured to connect with the polishing table 15 and is adapted to rotate it in a predetermined direction and speed. A pad 16 is placed on the upper surface of the polishing table 15, and is figured to contact an object 31 to be polished (such as a "wafer"), and to perform a polishing operation on the wafer 31.

The carrier head 17, which is designed to rotate in a predetermined direction and speed, is connected to the carrier head motor 13 by a driving shaft 14, and supplies a predetermined pressure on the wafer 31 located thereunder. The carrier head motor 13 is connected to second polishing end point detector 19. Second polishing end point detector 19 detects a polishing end point by analyzing the changes of load current, resistance, and voltage of the carrier head motor 13.

Figure 11:
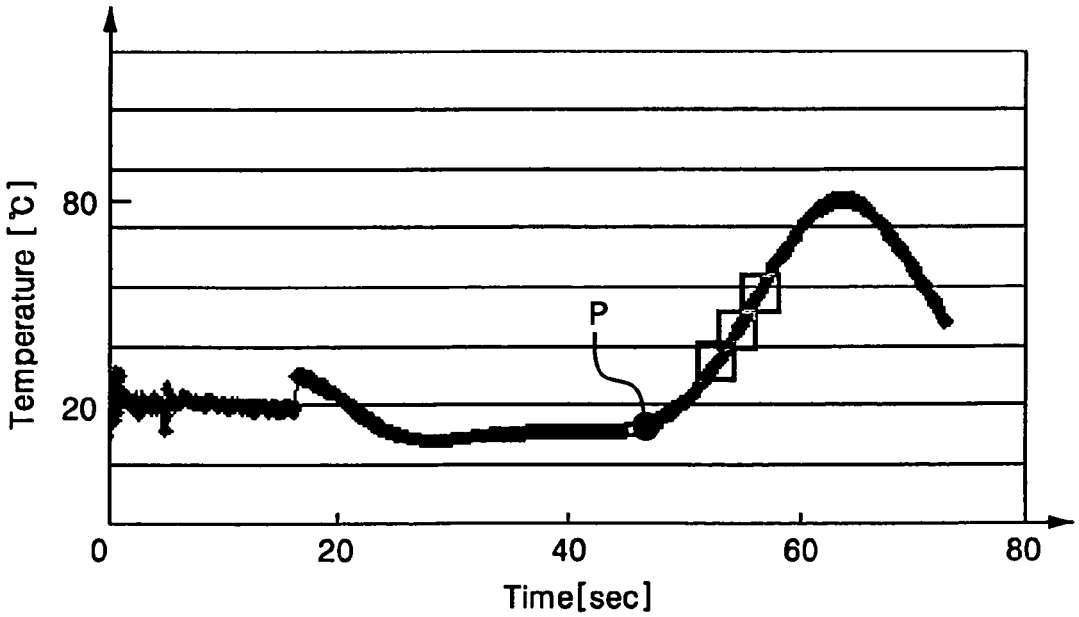
FIG. 11 is a graphical representation to illustrate the results of the detected temperature change by a monitoring unit over a given time period.

The temperature sensor 23 is connects with the first polishing end point detector 21, and measures the temperature generated during the polishing process. Then, the first polishing end point detector 21 detects the change in the process temperature, and determines a polishing end point. The first polishing end point detector 21 is connected to monitoring unit 27, and the monitoring unit 27 which is adapted to show the change of the process temperature with respect to the polishing process time as set forth in the graphical representation of FIG. 11.

Slurry supplier 29 is located over the pad 16. Slurry supplier 29 supplies a slurry to the upper surface of the pad 16.

The controller 25, which is connected to the first polishing end point detector 21 and the second polishing end point detector 19, receives a signal detecting the polishing end point. Thus, the controller 25 is connected to the polishing table motor 11, the carrier head motor 13, and the slurry supplier 29, and outputs a driving stop signal to the three units when it receives the detecting signal of the polishing end point.

Figure 2:
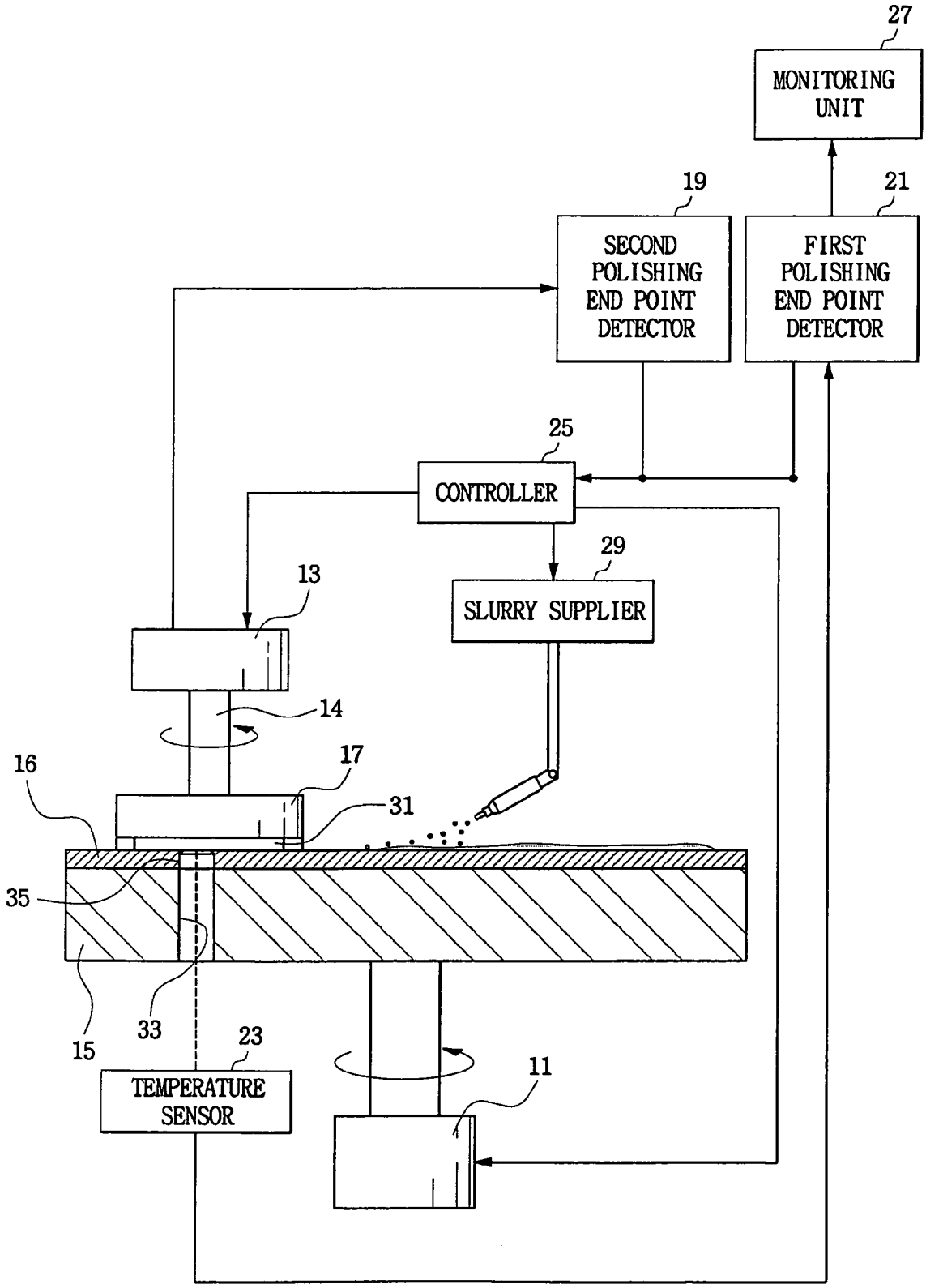
FIG. 2 illustrates an exemplary construction configured to sense the temperature of a wafer using the temperature sensor of FIG. 1.

As shown in FIG. 2, at least one opening 33 is provided in the polishing table 15 extending through the pad 16 and the polishing table 15. A temperature sensor 23 is installed through the opening 33, and is designed to detect the temperature of the wafer 31. It is preferable to further install a cover member 35 above the opening 33 in order to prevent the slurry supplied from slurry supplier 29, and the by-products generated during the polishing process, from passing into opening 33. Further, the polishing region can be divided into a plurality of locations. Opening 33 can be provided at each location so that the polishing end points at every location can be detected.

The temperature sensor 23 can use various types of temperature sensors such as thermocouples, infrared detectors, etc. In the case of using the infrared detector, the cover member 35 is preferably formed of a material which allows infrared rays to be transmitted therethrough. Such a construction is similar to a structure employing optical system 40, which will be hereinafter described.

Figure 3:
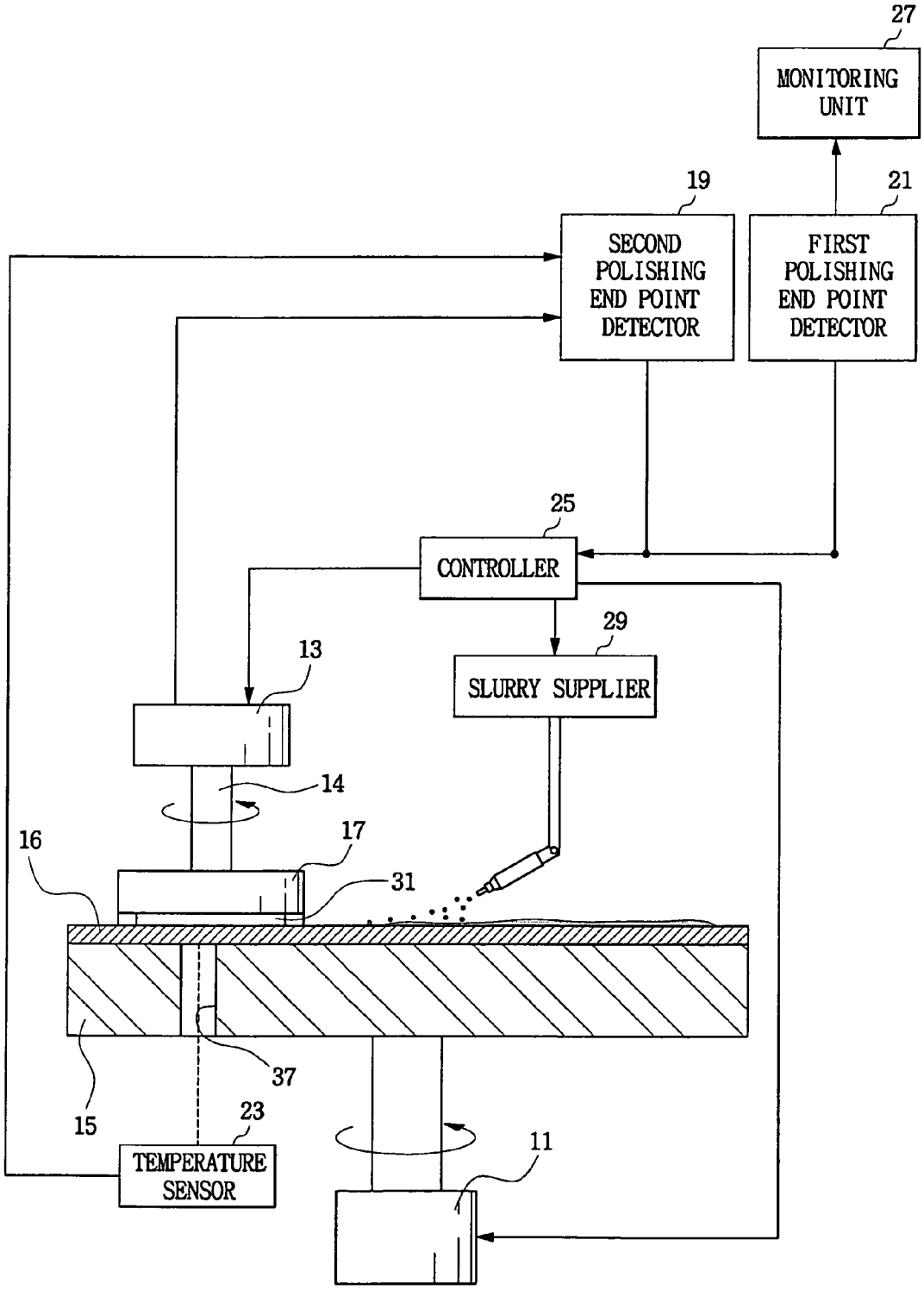
FIG. 3 illustrates an exemplary construction configured to sense the temperature of a pad using the temperature sensor of FIG. 1.

The system of FIG. 3 detects the temperature of the pad 16 in a polishing process in which the temperature sensor 23 is installed through at least one polishing table through opening 37 extending through the polishing table 15. In this structure, the opening 37 does not extend through the pad 16 so that the temperature of the wafer 31 is indirectly detected. The temperature sensor 23 can use various types of temperature sensors such as thermocouples, infrared detectors, etc. As in the structure of FIG. 2, a plurality of polishing table openings 37 can be provided in the polishing table 15 in a plurality of locations.

Figure 4:
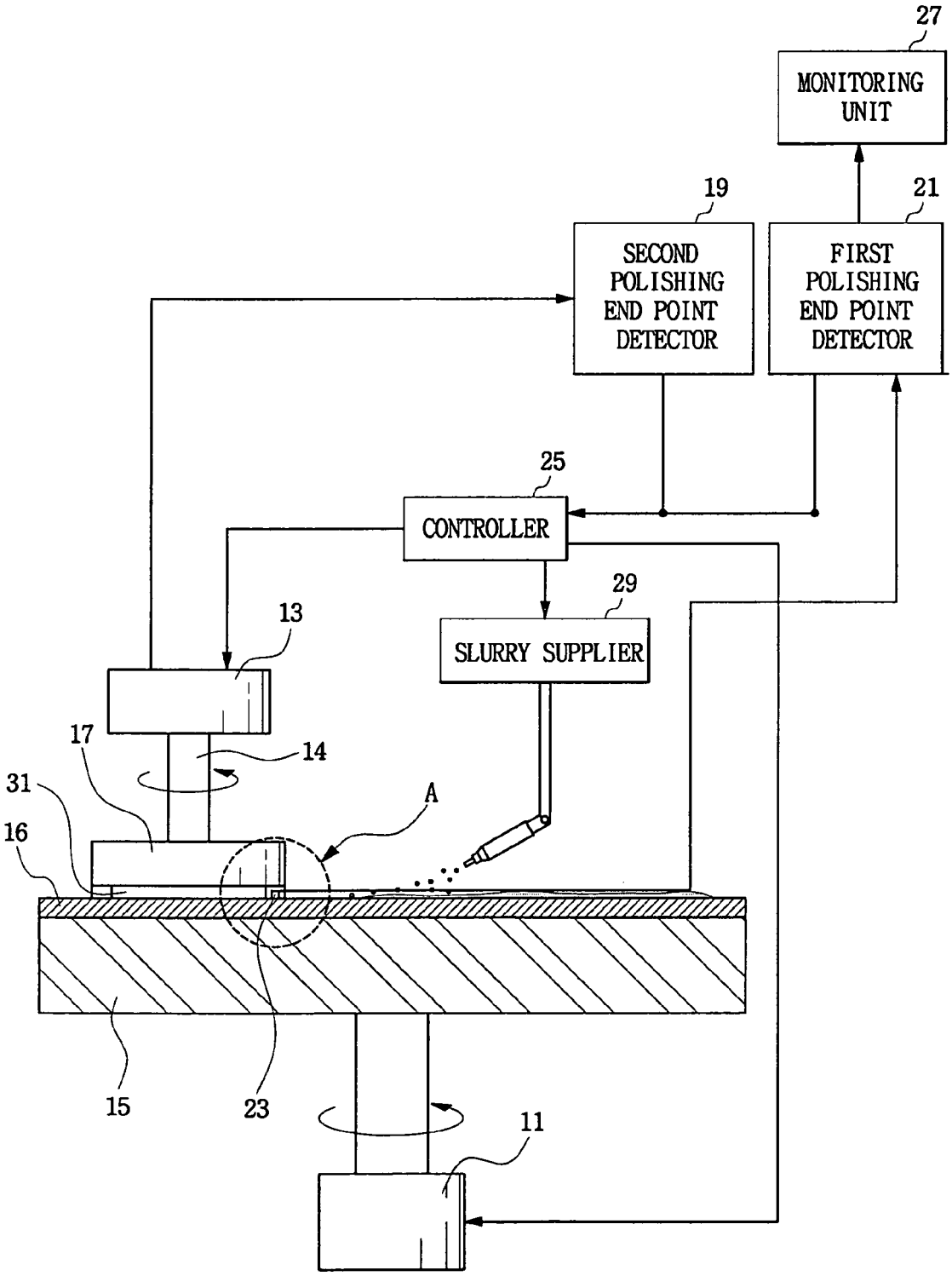
FIG. 4 illustrates an exemplary construction configured to sense the temperature of a slurry using the temperature sensor of FIG. 1.
Figure 5:
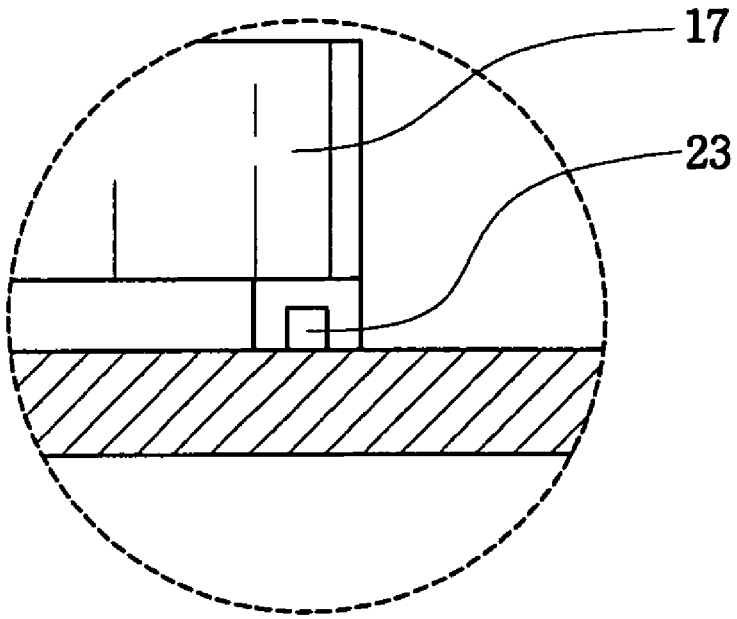
FIG. 5 is an enlarged view of the circled portion A of FIG. 4.

FIG. 4 and FIG. 5 illustrate embodiments which are configured to detect the temperature of the slurry supplied to the upper surface of the pad 16 during the polishing process. In the construction, the temperature sensor is installed on the bottom edge side of the carrier head 17. More specifically, while carrier head 17 rotates and performs the polishing process, the temperature of the slurry flowing through the edge portion of the wafer is detected. This system is also configured to indirectly detect the temperature of the wafer 31.

A process of detecting a polishing end point by the conventional CMP apparatus as structured above will now be described in more detail.

First, the wafer 31 is provided under the carrier head 13, and the wafer 31 on the pad 1, located on the polishing table 15, is compressed by the carrier head 13. At the same time, the polishing table 15 and the carrier head 13 are rotated such that the pad 16 and the wafer 31 opposed engage each other to be polished. A slurry is supplied in a location above the polishing table 15. The slurry uses a suspension of particles in an alkaline solution. The wafer 31 is planarized by the combination of the chemical polishing operation caused by the alkaline solution and the mechanical polishing action of the particles in the solution.

During the polishing process, the second polishing end point detector 19 detects load current, resistance or voltage from the carrier head motor 13, and compares the detected values to a standard value to detect a polishing end point. The wafer 31 is illustratively depicted with metal circuit lines and an interlayer insulating layer sequentially stacked thereon. First, when the polishing process reaches the stage that the interlayer insulating layer is all polished, and the metal circuit lines start to be polished, the polishing speed is changed so as to change the load current of the motor. The second polishing end point detector 19 determines the polishing end point.

In the meantime, the temperature of the wafer, the pad, and the slurry is detected continuously by the temperature detector 23, and the first polishing end point detector 21 determines a polishing end point based on the data for the temperature detected value. As described above, the illustrative wafer depicted comprises metal circuit lines and an interlayer insulating layer sequentially stacked thereon. During the polishing process, a frictional force is generated in the polishing region, and the surface of the wafer 31 is polished by the friction energy. Frictional heat is additionally generated from the polishing region (including the wafer to be polished, the pad, and the slurry) by the friction energy. Due to this frictional effect, the temperature of the wafer is gradually increased when the polishing is performed on an initial interlayer insulating layer, but it eventually maintains a constant level as graphically shown in FIG. 11. Then, after the interlayer insulating layer is fully polished, and when the metal circuit lines start to be polished, the polishing action stops, and the friction is increased. Thus, the temperature of the polishing region is rapidly increased. The first polishing end point detector 21 determines the point (P display) so as to detect the polishing end point.

As described above, when the polishing end point is detected by the current change of the carrier head motor 13, and the temperature change of the temperature sensor, the temperature change occurs more slowly than the current change of the motor. In a typical state, the polishing end point is first detected by the second polishing end point detector 19. Thus, in the case that the signal transmitted to the second polishing end point detector 19 has too much noise therein, so that it is not transmitted properly, the polishing process still continuously performs. In this case, the first polishing end point detector 21 first detects a polishing end point based on the temperature change by the temperature sensor 23, and the polishing end point detection by the second polishing end point detector 19 is forced to stop. As described above, if the polishing end point is detected by the second polishing end point detector 19 or the first polishing end point detector 21, the polishing end point signal is transmitted to the controller 25, and the controller 25 outputs a driving stop signal to the polishing table motor 11, the carrier head motor 13, and the slurry supplier 29, so as to complete the polishing process.

Figure 6:
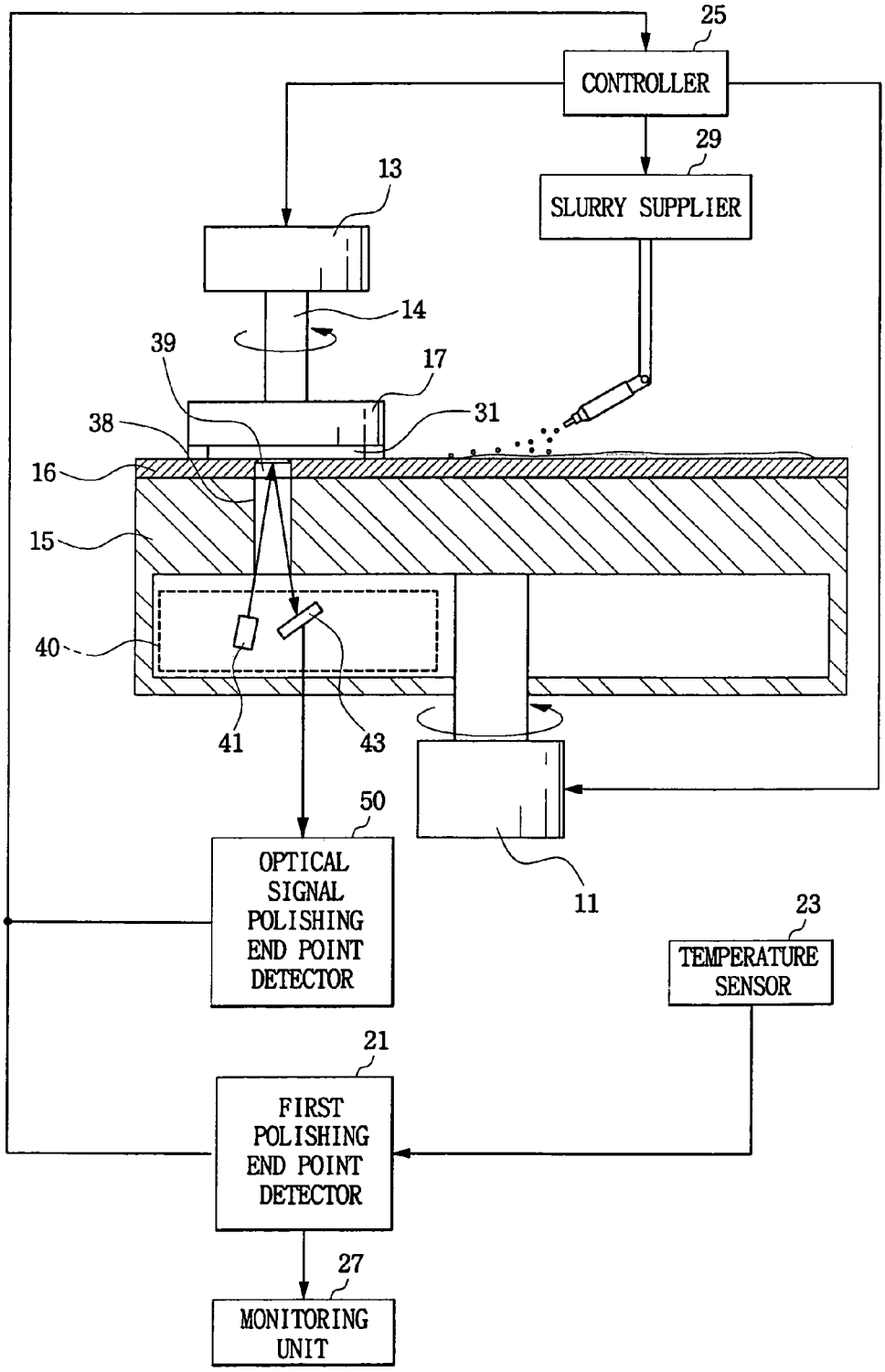
FIG. 6 schematically illustrates the construction of a CMP apparatus according to another embodiment of the present invention.
Figure 7:
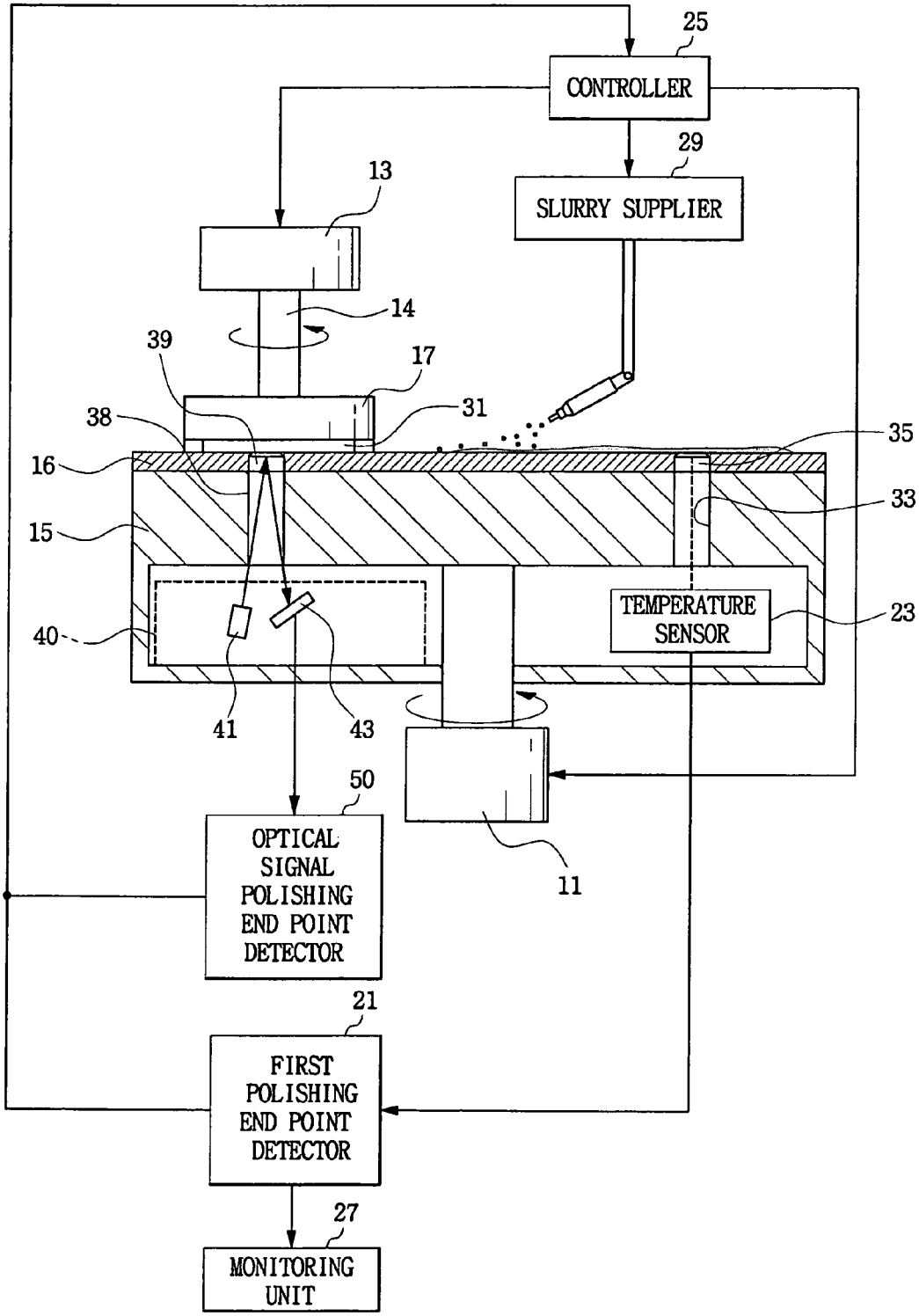
FIG. 7 illustrates an exemplary construction configured to sense the temperature of a wafer using the temperature sensor of FIG. 6.
Figure 8:
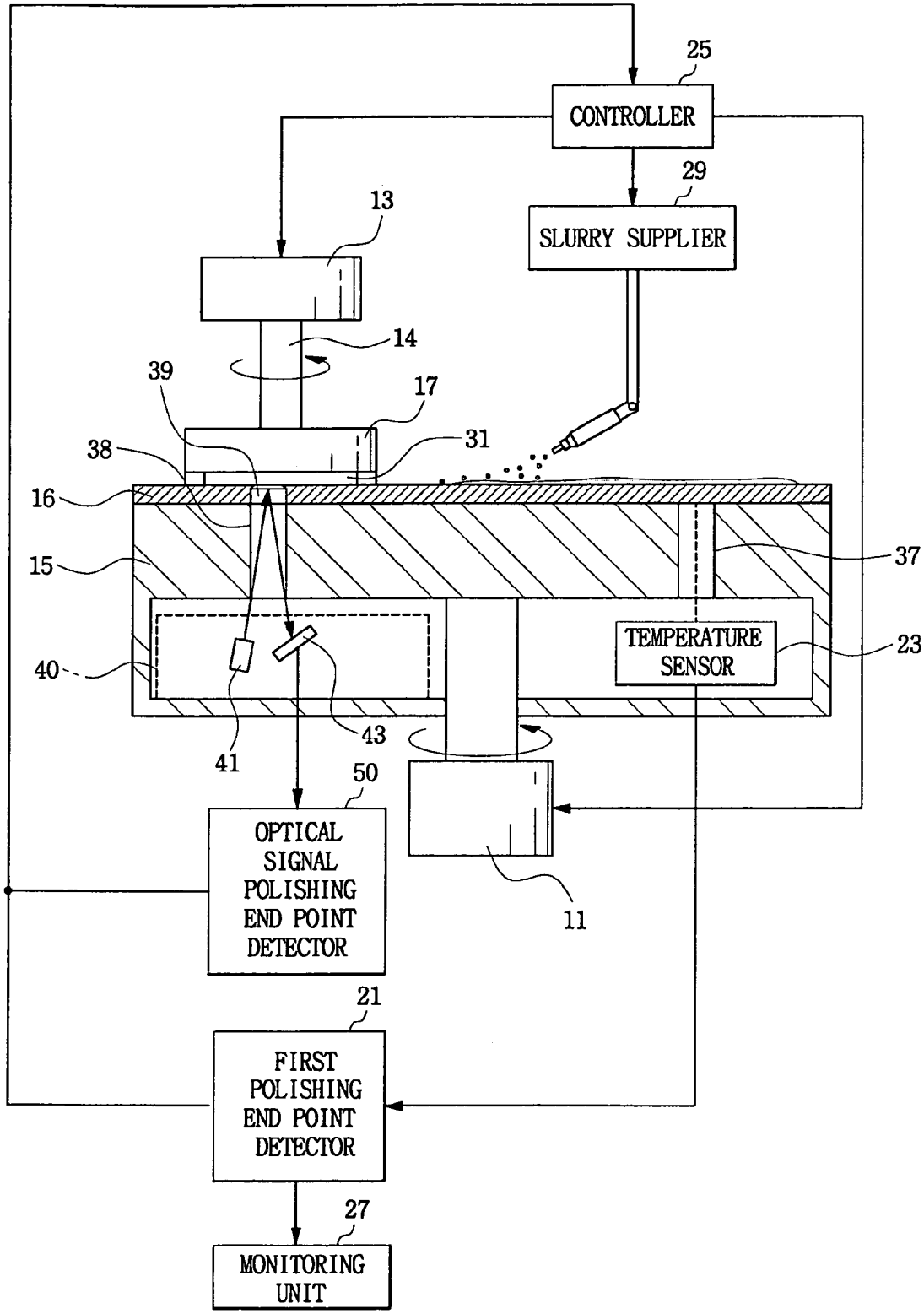
FIG. 8 illustrates an exemplary construction figured to sense the temperature of a pad using the temperature sensor of FIG. 6.
Figure 9:
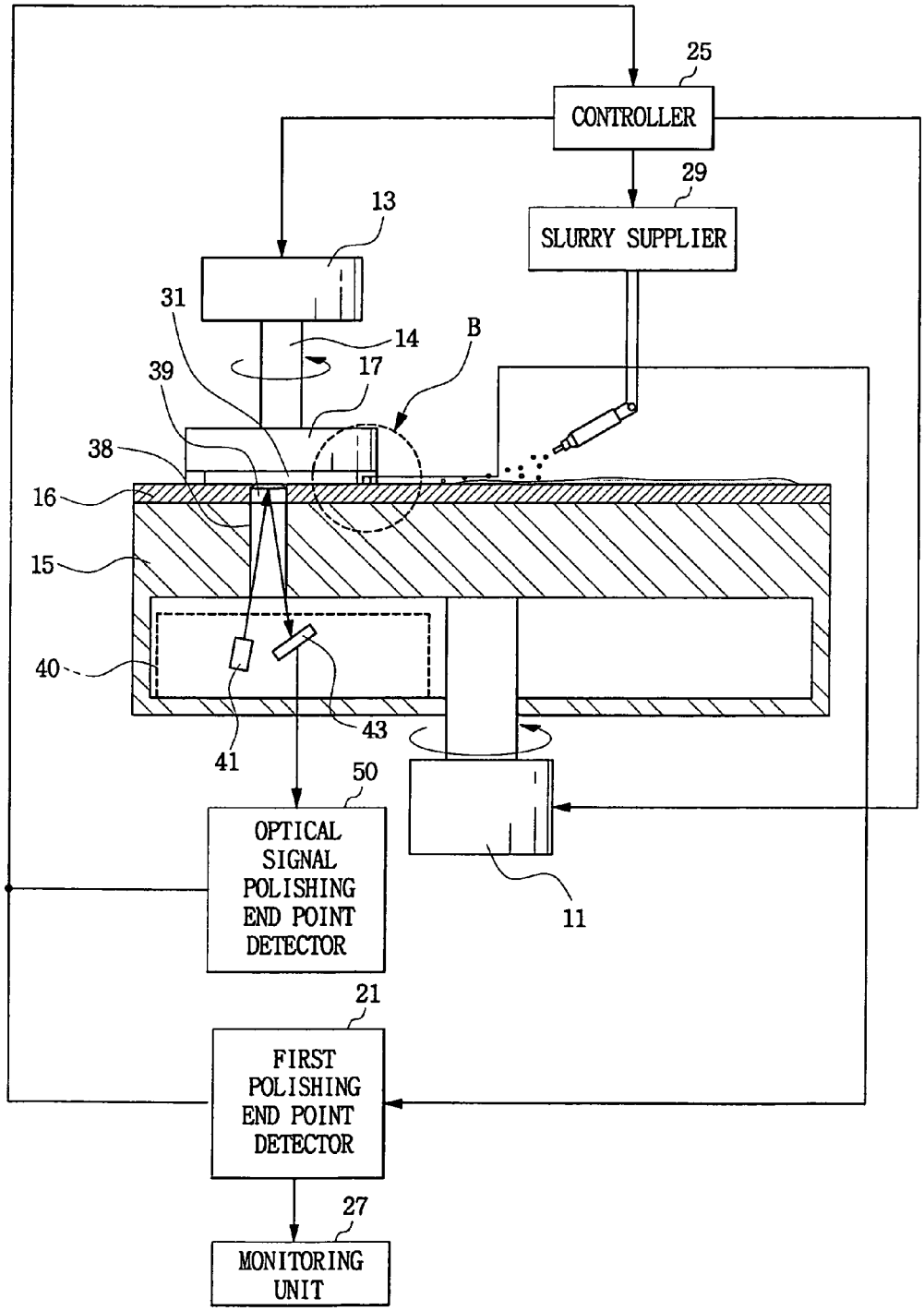
FIG. 9 illustrates an exemplary construction figured to sense the temperature of a slurry using the temperature sensor of FIG. 6.
Figure 10:
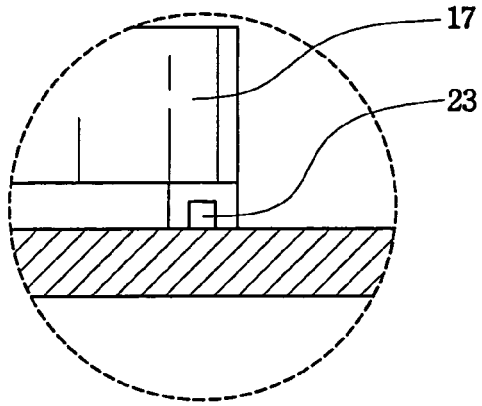
FIG. 10 is an enlarged view of the circled portion A of FIG. 9.

FIG. 6 illustrates the construction of the CMP apparatus according to another embodiment, and FIGS. 7 and 10 are views illustrating the various exemplary systems in which the temperature sensor of FIG. 6 is installed. The difference between this and the first embodiment is the replacement of the second polishing end point detector 19 which detects a polishing end point employing the current change of the carrier motor 13. In this embodiment, an optical signal polishing end point detector 50 is employed to detect a polishing end point based on the values of the optical signals transmitted by an optical system 40.

As shown in FIG. 7, the optical system 40 includes a light emitter 41 for emitting an illuminated light toward the wafer 31, and a light receiver 43 for receiving the illuminated light reflected from the wafer 31. An optical sensing aperture 38 is formed in the polishing table 15 and the pad 16 in order to form the passage of the illuminated light. A second cover member 39 is formed above the optical sensing aperture 38 in order to prevent the slurry supplied or the by-products generated during the polishing process, respectively, from passing thereinto. Such a construction is similar to that of the temperature sensor 23 for detecting the temperature of the wafer 31 as depicted in FIG. 2. An optical signal polishing end point detector 50 is connected to the light receiver 43 which detects a polishing end point based on the receiving signal of the light receiver 43.

The optical system 40 described as above can be installed at each of the plurality of locations of the polishing region, in order to facilitate the detection of a more exact removal rate of polishing.

The detection of a polishing end point by the optical signal polishing end point detector 50 and the first polishing end point detector 21 is hereinafter described. A typical polishing process and a polishing end point detection process by the temperature sensor 23 are the same as the first embodiment, as is the detection of a polishing end point is performed by optical wave values using the optical system 40 instead of the detection of a polishing end point by the current value of the carrier head motor 13. First, a predetermined illuminated light is emitted from the light emitter 41, and the illuminated light is reflected at a predetermined angle from the surface of the wafer 31 into the light receiver 43. In this way, the optical signal polishing end point detector 50 compares the light-receiving signal value coming into the light receiver 43 to a standard value, so as to determine a polishing end point. However, the optical system 40 may malfunction and not exactly detect the polishing end point. In this instance, the change of a polishing process temperature is detected by the temperature sensor 23, and a polishing end point is detected by the first polishing end point detector 21. Accordingly, the occurrence of the error is detected during the course of determining the polishing end point.

As described above, when detecting a polishing end point employing the optical reflectivity of the optical system 40, and by using the temperature change in the temperature sensor, the change of the temperature occurs gradually compared to the optical reflection, and the polishing end point is first detected by the optical signal polishing end point detector 50 in a typical state. However, in the event that the signal transmission is not made properly due to the malfunction of the optical system 40, the polishing process cannot be continuously performed. However, in such a case, when the first polishing end point detector 21 first detects the polishing end point based on the temperature change by the temperature sensor 23, the polishing end point detection process determined by the optical signal polishing end point detector 50 is terminated. When the polishing end point is detected by the first polishing end point detector 21 or the optical signal polishing end point detector 50, the polishing end point detection signal is transmitted to the controller 25, and the controller 25 outputs the driving stop signal to the polishing table motor 11, the carrier head motor 13, and the slurry supplier 29, so as to complete the polishing process.

According to the present invention, the detection of a polishing end point can be performed in more improved ways by detecting the polishing end point through the process temperature change along with the detection of a polishing end point by the current change of a motor which drives a carrier head, or by the change of the optical waves using an optical system.

What is claimed is:

1. A chemical mechanical polishing (CMP) apparatus comprising:

a rotatable polishing table;

a polishing pad located on the polishing table;

a rotatable carrier head located above the polishing table which is rotatably driven by a carrier head driving device;

a wafer located under, and rotatably driven by, the carrier head;

a slurry supplier for supplying a polishing slurry to the upper portion of the polishing table;

at least one temperature sensor for detecting the polishing process temperature of at least one of the wafer, the pad, and the slurry;

a first polishing end point detector for determining a polishing end point based on temperature changes measured by the temperature sensor; and a second polishing end point detector for determining a polishing end point based on changes in load current, voltage, and resistance of the carrier head driving device.

2. The CMP apparatus according to claim 1, which further includes at least one opening extending through the polishing pad and the polishing table, the temperature sensor being in communication with each said opening and detecting the temperature of the wafer through each said opening.

3. The CMP apparatus according to claim 2, wherein a cover member is installed above the opening.

4. The CMP apparatus according to claim 1, which further includes at least one opening extending through the polishing table, the temperature sensor being in communication with the opening and detecting the temperature of the pad through said opening.

5. The CMP apparatus according to claim 1, wherein the temperature sensor is installed on the bottom edge of the carrier head to detect the temperature of the slurry.

6. The CMP apparatus according to claim 1, wherein the temperature sensor is an infrared detector.

7. The CMP apparatus according to claim 1, further comprising a monitoring unit for displaying the results of the change of the polishing process temperature detected by the first polishing end point detector.

8. A chemical mechanical polishing (CMP) apparatus comprising:

a rotatable polishing table;

a polishing pad located on the polishing table;

a rotatable carrier head located above the polishing table and rotatably driven by a carrier head driving device;

at least one temperature sensor for detecting the polishing process temperature of at least one of and the pad;

a first polishing end point detector for detecting a polishing end point through the temperature change of the temperature sensor; and an optical signal polishing end point detector installed within the confines of the polishing table, in communication with the wafer, for detecting an optical signal of light illuminated onto the wafer and reflected from the wafer so as to detect a polishing end point.

9. The CMP apparatus according to claim 8, which further includes at least one opening extending through the polishing pad and the polishing table, the temperature sensor being in communication with said opening and detecting the temperature of the wafer through said opening.

10. The CMP apparatus according to claim 9, wherein a cover member is installed above the opening.

11. The CMP apparatus according to claim 8, which further includes at least one opening extending through the polishing table, the temperature sensor being in communication with the opening and detecting the temperature of the pad through said opening.

12. The CMP apparatus according to claim 8, further comprising a slurry supplier for supplying a slurry to the upper portion of the polishing table.

13. The CMP apparatus according to claim 8, wherein the temperature sensor is an infrared detector.

14. The CMP apparatus according to claim 8, further comprising a monitoring unit for displaying the results of the change of the polishing process temperature with respect to polishing process time, detected by the first polishing end point detector.

15. The CMP apparatus according to claim 12, wherein the temperature sensor is installed on the bottom edge of the carrier head to detect the temperature of the slurry.

16. A chemical mechanical polishing method comprising:

providing a rotatable polishing table, a polishing pad located on the polishing table, and a rotatable carrier head located above the polishing table;

providing a wafer located under, and driven by, the carrier head;

driving the carrier head and rotating the wafer;

supplying a polishing slurry to the upper portion of the polishing table;

detecting a polishing process temperature of at least one of the wafer, the pad, and the slurry;

determining a polishing end point based on temperature changes measured by the temperature sensor; and determining a polishing end point based on changes in load current, voltage, and resistance of the carrier head driving device.

17. The method according to claim 16, which further includes at least one opening extending through the polishing pad and the polishing table, the temperature sensor being in communication with each said opening and detecting the temperature of the wafer through said opening.

18. The method according to claim 16, which further includes at least one opening extending through the polishing table, the temperature sensor being in communication with the opening and detecting the temperature of the pad through said opening.

19. The method according to claim 16, further comprising the step of displaying the results of the change of the polishing process temperature detected by the first polishing end point detector.

20. The method according to claim 16, further comprising the step of detecting an optical signal of light illuminated onto the wafer and reflected from the wafer so as to detect a polishing end point.

* * * * *

UNITED STATES PATENT AND TRADEMARK OFFICE

CERTIFICATE OF CORRECTION

PATENT NO. : 6,976,902 B2
APPLICATION NO. : 10/850688
DATED : December 20, 2005
INVENTOR(S) : Koo et al.

It is certified that error appears in the above-identified patent and that said Letters Patent is hereby corrected as shown below:

Column 8, line 17, please replace “one of and” with --one of a wafer--

Signed and Sealed this

Seventh Day of November, 2006

JON W. DUDAS
*Director of the United States Patent and Trademark Office*